US009165522B2

(12) United States Patent
Ding

(10) Patent No.: US 9,165,522 B2
(45) Date of Patent: Oct. 20, 2015

(54) METHOD FOR PIXEL GRADATION EXTENSION, DRIVE METHOD AND APPARATUS FOR CHARGING TIME OF PIXEL CAPACITANCE

(75) Inventor: Yue Ding, Beijing (CN)

(73) Assignee: BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 1535 days.

(21) Appl. No.: 12/129,832

(22) Filed: May 30, 2008

(65) Prior Publication Data

US 2009/0079683 A1 Mar. 26, 2009

(30) Foreign Application Priority Data

Sep. 21, 2007 (CN) ..... 2007 1 0122161

(51) Int. Cl.
*G09G 3/20* (2006.01)
*G09G 3/36* (2006.01)

(52) U.S. Cl.
CPC ..... *G09G 3/3688* (2013.01); *G09G 3/2011* (2013.01); *G09G 3/2081* (2013.01); *G09G 2310/027* (2013.01); *G09G 2310/0259* (2013.01)

(58) Field of Classification Search
USPC ..... 345/89
See application file for complete search history.

(56) References Cited

U.S. PATENT DOCUMENTS 6,480,180 B1 * 11/2002 Moon ..... 345/98
6,658,583 B1 * 12/2003 Kudo et al. ..... 713/500
2003/0011583 A1 * 1/2003 Yamazaki ..... 345/204
2005/0162365 A1 * 7/2005 Aoki ..... 345/96
2007/0211011 A1 * 9/2007 Lee ..... 345/100
2007/0268225 A1 * 11/2007 Woo et al. ..... 345/89
2008/0111838 A1 * 5/2008 Nakanishi ..... 345/690

FOREIGN PATENT DOCUMENTS

| | | | |
|---|---|---|---|
| CN | 101034523 A | | 9/2007 |
| JP | 06-273722 A | | 9/1994 |
| JP | 07-225567 A | | 8/1995 |
| JP | 2000-066642 A | | 3/2000 |
| JP | 2001-356745 A | | 12/2001 |
| JP | 2003-114638 A | | 4/2003 |
| JP | 2007-241228 A | | 9/2007 |
| KR | 10-2007-00636 40 | * | 6/2007 |
| KR | 20070063640 A | | 6/2007 |

* cited by examiner

*Primary Examiner* — Jonathan Horner
*Assistant Examiner* — Joseph Fox
(74) *Attorney, Agent, or Firm* — Ladas & Parry LLP

(57) ABSTRACT

The present invention relates to a method of extending a pixel gray scale. The secondary gray scale levels with different charging times and the same gray scale voltage are formed by controlling a charging time of the gray scale voltage of every primary gray scale level and refining the level, wherein, the gray scale voltage of the every secondary gray scale level is the same as that of the corresponding primary gray scale level, and its charging time corresponds to the secondary gray scale level. The primary gray scale level of the display pixel of the liquid crystal panel is extended by using this method and the disadvantage of the imperfect display brought forward by the control method using frame rate in the prior art is overcome. The present invention further provides a drive method of controlling the pixel charging time and a drive apparatus thereof, which realizes the pixel gray scale extension by controlling the charging time of the pixel capacitance. It overcomes the disadvantage that a grid strip may be formed visually using the characteristic of the visual retention and the visual inertia of the human eyes while largely increasing the number of colors that can be displayed.

12 Claims, 6 Drawing Sheets

Charging Time
Data
6 bit: GL(n)
8 bit: GL(4n)
6 bit: GL(n)
8 bit: GL(4n+1)
t1
6 bit: GL(n)
8 bit: GL(4n+2)
t2
6 bit: GL(n)
8 bit: GL(4n+3)
t3
Gate Charging Time
A
B
Data
6 bit: GL(0)
8 bit: GL(0)
6 bit: GL(0)
8 bit: GL(1)
t1
6 bit: GL(0)
8 bit: GL(2)
t2
6 bit: GL(0)
8 bit: GL(3)
t3
6 bit: GL(1)
8 bit: GL(4)
Gate

METHOD FOR PIXEL GRADATION EXTENSION, DRIVE METHOD AND APPARATUS FOR CHARGING TIME OF PIXEL CAPACITANCE

TECHNICAL FIELD

The present invention relates to a method of generating a pixel gray scale, and in particular, relates to a method of extending the pixel gray scale by controlling an pixel charging time. The present invention relates to a drive method of controlling a gray scale voltage on a liquid crystal pixel and a drive apparatus thereof, and in particular, relates to a drive method of controlling a charging time of a pixel capacitance and a drive apparatus thereof.

BACKGROUND ART

The color display ability of a liquid crystal panel is described by the number of bits of the gray scales that can be displayed on the liquid crystal panel over each kind of color channel. Currently, a 6-bit liquid crystal display panel is commonly used, the 6-bit panel referring to the panel that can display 2 to the sixth power, that is 64, levels of gray scales and have three color channels of red, green and blue (refer to as RGB thereafter for short), so that 262144 colors (64×64×64=262144) can be displayed. It can be deduced that a 8 bit panel displays 256 levels of gray scales and 16777216 (16.7M) colors can be displayed. It can be seen that the colors that can be physically displayed on the 6-bit panel does not reach 2% of that of the 8 bit panel yet. So color enhancement technique is employed for the purpose of shortening the difference between the 6-bit panel and the 8 bit panel and prolonging the lifetime of the 6-bit panel. The color enhancement technique mainly comprises a Pixel Dithering (refer to as PD thereafter for short) Algorithm and a Frame Rate Control (refer to as FRC thereafter for short) technique.

Discontinuous color scales 0, 4, 8, 12, 16, 20 . . . , 252 are provided by the 6-bit panel while continuous color scales 0, 1, 2, 3, 4 . . . , 255 are provided by the 8 bit panel, which result in the colors of the 6-bit panel less than those of the 8 bit panel. The principle of the PD algorithm is to switch adjacent colors locally in a short time to obtain the lacked colors using the visual retention effect of the human eye. The first method is to display the level 0 of the gray scale at the timing of T0, the level 4 of the gray scale at the timing of T1 repeatedly on the same pixel, to mix the two kinds of the pixel gray scale information by using the visual retention of the human eye, and thus 2 levels of the gray scale can be substantially obtained; the second method is to use a pixel square matrix formed of four pixels, in which two pixels on the diagonal direction display the same level 0 of the gray scale or level 4 of the gray scale respectively, and the color information of 2 levels of the gray scale can be obtained by users on observation distance. More color scales are obtained by the 6-bit panel by using this method.

FRC technique mainly utilizes the visual inertia of the human eye, which means that the feeling of human eyes to the brightness does not disappear immediately as the brightness of the object disappears, but disappears after a period of time. Take a simple case for example: firstly adjusting the screen of a CRT display to pure red color on full-screen, then switching to pure yellow color through one key on full-screen, at the instant of the switching, what we "see" on the screen is neither red nor yellow, but orange. The reason is that the previous red color has remained in the eye because of the visual inertia, and the newly incoming yellow color is superposed on the temporarily remained red color feeling, then we "see" orange, a color that does not exist originally. FRC technique utilizes this principium, and exhibits an all-color picture in an emulated manner by controlling the frame rate and the color between the adjacent frames properly and controlling the data output spatially and temporally, so that we "see" the color that cannot be displayed by the liquid crystal panel itself when the moving pictures are played on the liquid crystal panel.

Both of the PD algorithm and the FRC technique can enable the liquid crystal panel to obtain more color scales, and extend the number of colors that can be displayed to 16.2 M. Currently, there further is a Hi-FRC (High FRC) technique which can extend the number of colors to 16.7 M.

All of the above utilize the characteristic of the visual retention and the visual inertia of the human eyes, and realize the extension to the number of the output gray scales by controlling the output data of the pictures for a plurality of continues frames. The disadvantage is that flickering of the picture may occur when displaying some specific pictures due to the specific algorithm applied to the processing of the data; a grid strip may further occur visually for the gray scale picture that has been performed FRC operation, because the human eye can capture slight variation of the picture.

SUMMARY OF THE INVENTION

One object of the present invention is to provide a method of extending the pixel gray scale by some embodiments, so that the number of the pixel gray scales can be extended and the disadvantage of the imperfect display due to the utilization of the characteristic of the visual retention and the visual inertia of the human eyes is overcome.

Another object of the present invention is to provide a drive method of controlling the charging time of the pixels by some embodiments, so that the output time of the charging voltage of the pixel capacitance is controlled to make the number of gray scales of the pixel extended.

A further object of the present invention is to provide a drive apparatus for controlling the charging time of the pixels, so that the output time of the charging voltage of the pixel capacitance is controlled to make the number of gray scales of the pixel extended.

To realize the first object of the present invention, A method of extending a pixel gray scale of some embodiments of the present invention comprises: controlling a charging time of a gray scale voltage of every primary gray scale level to form a plurality of secondary gray scale levels with different charging times and the same gray scale voltage, wherein the gray scale voltage of the every secondary gray scale level is the same as that of the corresponding primary gray scale level, and its charging time corresponds to the secondary gray scale level.

To realize another object of the present invention, a drive method of controlling a pixel charging time of some other embodiments of the present invention comprises:

intercepting higher 6 bits data signal of a 8 bits low-voltage differential signal and storing it in the data buffer temporarily;

generating a mini-type low voltage differential signal or a low-amplitude differential signal by format conversion processing to the higher 6 bits data signal in the data buffer;

D/A converting the mini-type low voltage differential signal or the low-amplitude differential signal to generate a gray scale voltage, and said gray scale voltage being output to a pixel capacitance to charge the pixel capacitance;

selecting a corresponding delay control time in accordance with the lower 2 bits data signal of the 8 bits low-voltage differential signal, and performing a delay processing to the charging time of the pixel capacitance in accordance with the delay control time.

To realize a further object of the present invention, a drive apparatus for controlling the pixel charging time of the further embodiments of the present invention comprises:

a first unit for intercepting higher 6 bits data signal of a 8 bits low-voltage differential signal to output to a format conversion unit, and to output a lower 2 bits data signal of the 8 bits low-voltage differential signal to a second unit;

the format conversion unit for generating a mini-type low voltage differential signal or a low-amplitude differential signal from the higher 6 bits data signal by format conversion processing;

a D/A conversion unit for performing D/A conversion to the mini-type low voltage differential signal or the low-amplitude differential signal to generate a gray scale voltage, and said gray scale voltage being output to a pixel capacitance to charge said pixel capacitance; and the second unit for selecting a corresponding delay control time in accordance with the lower 2 bits data signal of the 8 bits low-voltage differential signal, and to perform delay processing to the charging time of the pixel capacitance in accordance with the delay control time.

It can be known from the above technical solutions that the extension method to pixel gray scale provided by the present invention can be realized by controlling the charging time of the pixel capacitance, overcomes the disadvantage of the imperfect display caused by using the characteristic of the visual retention and visual inertia of the human eyes, and improves the display quality of the liquid crystal picture. The drive method of controlling pixel charging time and the drive apparatus thereof provided by the present invention realize the pixel gray scale extension by controlling the charging time of the pixel capacitance. It overcomes the disadvantage of probably forming grid strip visually when using the characteristic of the visual retention and visual inertia of the human eyes while increasing the number of colors that can be displayed.

The present invention will be further described in detail with reference to the drawings in combination with the detailed embodiments.

DETAILED DESCRIPTION OF THE INVENTION

The extension method to the pixel gray scale in the prior art is to mix different pixel colors by utilizing the characteristic of the visual retention and the visual inertia of the human eyes. In the following embodiments of the present invention, 256 levels of gray scale voltages are converted into 64 levels of gray scale voltages to output by dividing a 8 bit input data in an unit of 4 levels of gray scales; then when the pixel capacitance on the liquid crystal panel is charged, a charging time of a pixel capacitance is controlled by controlling an output time of each level of the output gray scale voltage, thus 3 levels of gray scales among every 4 levels of gray scales are differentiated to realize the object of displaying 256 levels of gray scales with a 6-bit data output from a source driver, so that the number of gray scales that can be displayed on the liquid crystal panel are increased and the kinds of colors are enriched.

Embodiment 1 of the Extension Method for the Pixel Gray Scale

The gray scale is realized by a source driver transmitting different gray scale voltages to pixel capacitances of the individual source channel on the liquid crystal panel. A 6-bit source driver can generate $2^6$=64 levels of gray scale voltages which charge to the pixel capacitance. 0-63 kinds of different charging conditions can be generated for the pixel capacitance in accordance with different levels of the applied gray scale voltages, and the liquid crystal molecule deflect under the electrical field effect of the pixel capacitance to generate the display effect of 64 levels of gray scales.

Figure 1:
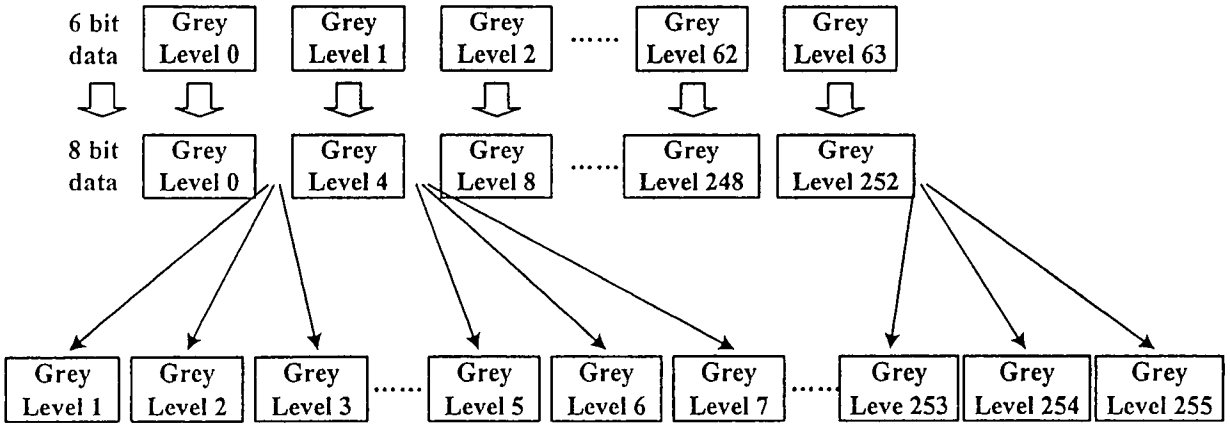
FIG. 1 is a schematic diagram of a gray scale extension scheme of the present invention.
Figures 2A, 2B, 2C, 2D, 2E:
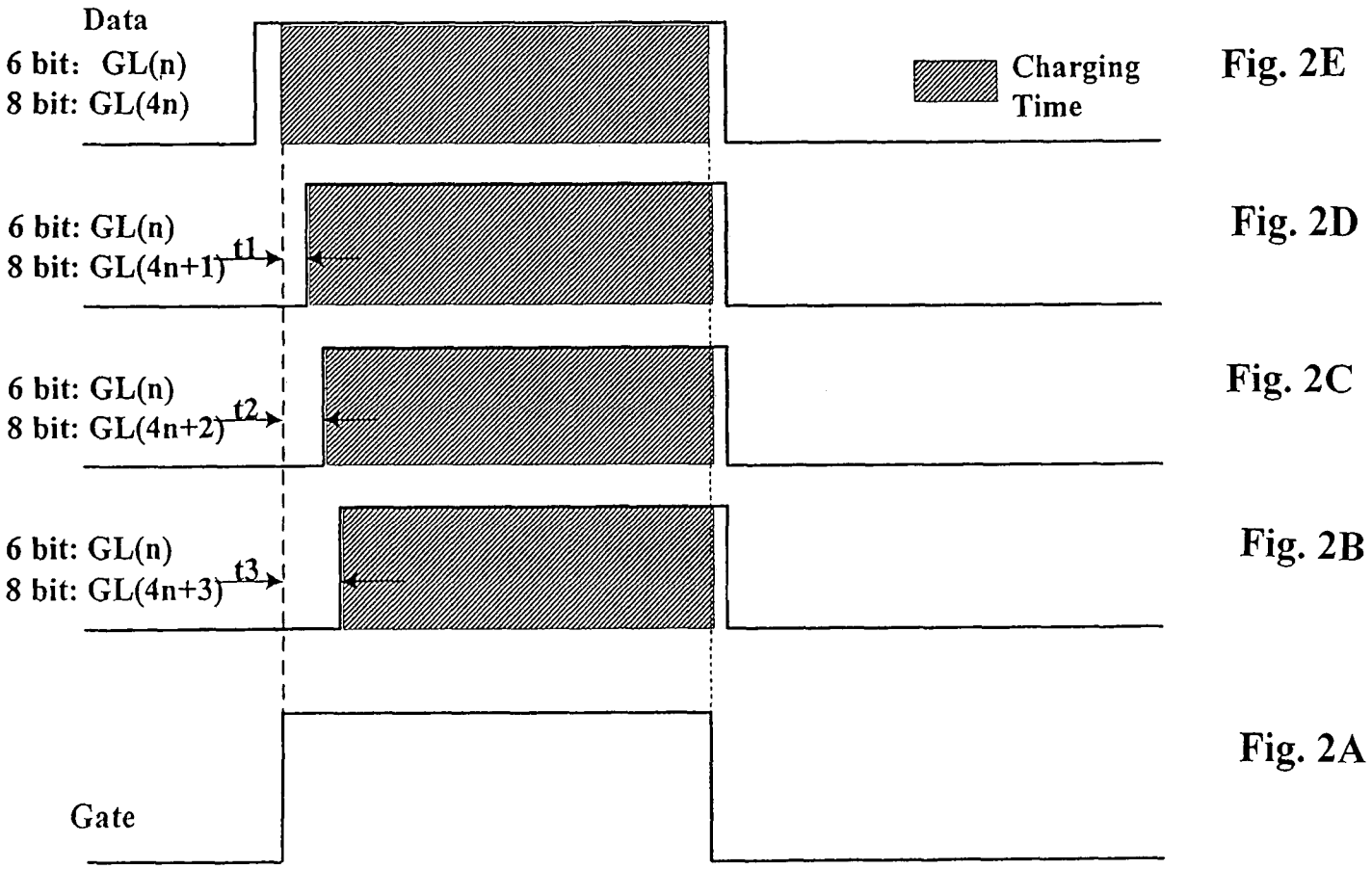
FIG. 2A is a schematic diagram of a step voltage applied at a gate as a function of time.
FIG. 2B is a schematic diagram of a charging time of the gray scale voltage corresponding to an 6 bit: GL(n) 8 bit: GL(4*n*+3) condition showing a t3 delay time.
FIG. 2C is a schematic diagram of a charging time of the gray scale voltage corresponding to an 6 bit: GL(n) 8 bit: GL(4*n*+2) condition showing a t2 delay time.
FIG. 2D is a schematic diagram of a charging time of the gray scale voltage corresponding to an 6 bit: GL(n) 8 bit: GL(4*n*+1) condition showing a t1 delay time.
FIG. 2E is a schematic diagram of a charging time of the gray scale voltage corresponding to an 6 bit: GL(n) 8 bit: GL(4*n*) condition showing no delay time.
Figures 3A, 3B, 3C, 3D, 3E, 3F:
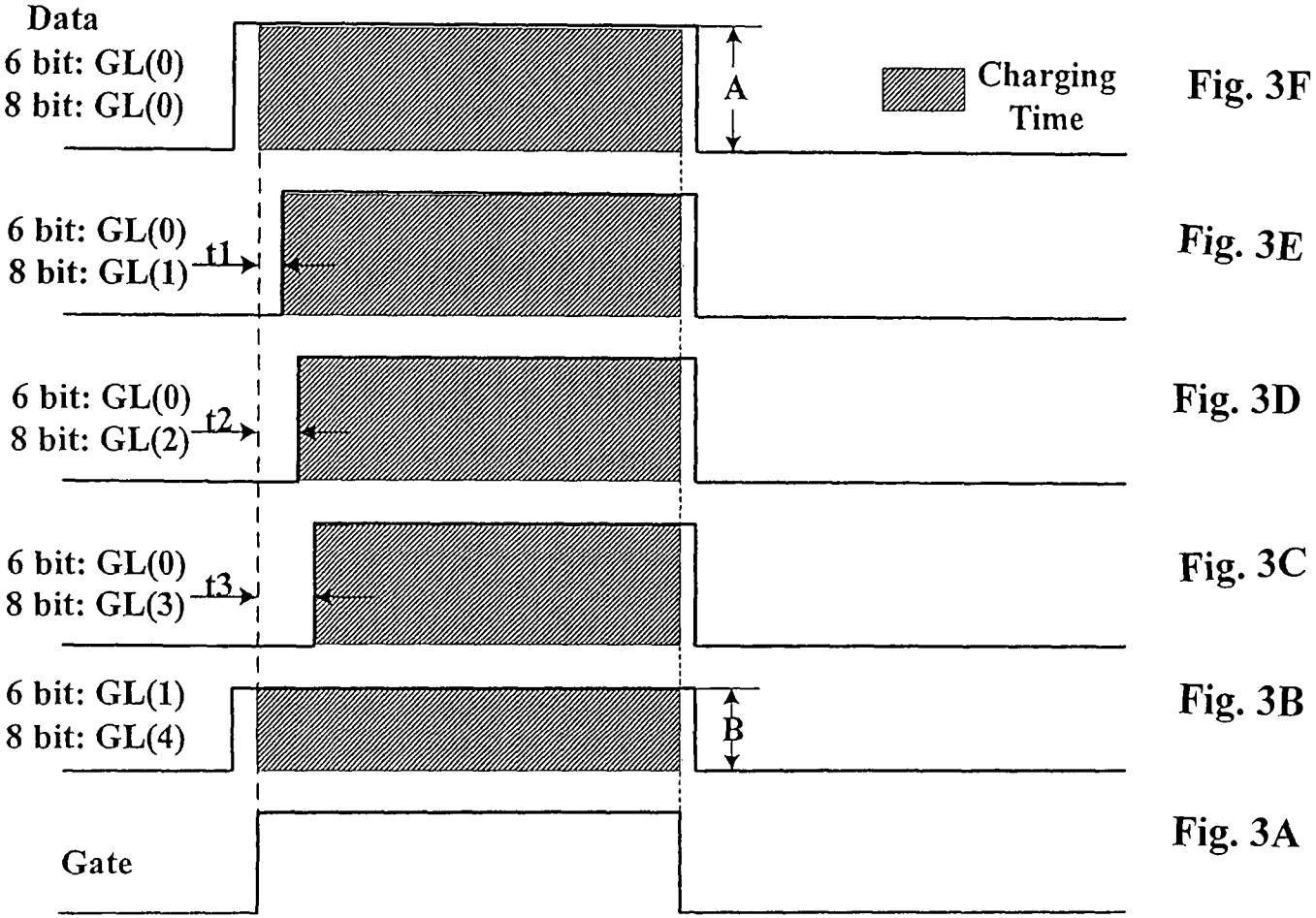
FIG. 3A is a schematic diagram of a step voltage applied at a gate as a function of time.
FIG. 3B is a schematic diagram of a charging time of the gray scale voltage corresponding to an 6 bit: GL(1) 8 bit: GL(4) condition showing a B voltage magnitude and no delay time.
FIG. 3C is a schematic diagram of a charging time of the gray scale voltage corresponding to an 6 bit: GL(0) 8 bit: GL(3) condition showing an A voltage magnitude and a t3 delay time.
FIG. 3D is a schematic diagram of a charging time of the gray scale voltage corresponding to an 6 bit: GL(0) 8 bit: GL(2) condition showing an A voltage magnitude and a t2 delay time.
FIG. 3E is a schematic diagram of a charging time of the gray scale voltage corresponding to an 6 bit: GL(0) 8 bit: GL(1) condition showing an A voltage magnitude and a t1 delay time.
FIG. 3F is a schematic diagram of a charging time of the gray scale voltage corresponding to an 6 bit: GL(0) 8 bit: GL(0) condition showing an A voltage magnitude and no delay time.

The output 6-bit data is to be extended, as shown in FIG. 1. A primary gray scale level n (refer to as GL(n) thereafter for short, wherein n is a positive integers 0~63) is extended into a secondary gray scale levels GL(4*n*), namely GL0, GL4, GL8, . . . , GL252, meanwhile three secondary gray scale levels of GL(4*n*+1), GL(4*n*+2) and GL(4*n*+3) are added after GL(4*n*). As shown, the one primary gray scale level of the original 6-bit data is extended to the current four secondary gray scale levels (GL(4*n*), GL(4*n*+1), GL(4*n*+2) and GL(4*n*+

3)), so that the original 64 levels of gray scales extend to 256 levels of gray scales, namely, the 6-bit data is extended into the current 8 bit data.

For the secondary gray scale levels (GL(4*n*)), the gray scale voltage is the output voltage of the 6-bit source driver. The voltages corresponding to the other extended secondary gray scale levels are controlled by controlling the charging time of the gray scale voltage for every primary gray scale level to gradually reduce the charging time of pixel capacitance, as shown in FIGS. 2A-2E. For example, the charging time of the extended GL(4*n*+1), GL(4*n*+2) and GL(4*n*+3) are delayed by t1, t2 and t3 respectively. The difference of the charging time results in the difference of the output time of the applied voltage to the pixel capacitance, thereby forming a different secondary gray scale levels corresponding to the applied gray scale voltages. The number of the gray scales of the secondary gray scale levels can be infinite in theory.

The extension to the gray scale can be realized by utilizing the control of the charging time of the liquid crystal pixel capacitance. The method is to improve the drive circuit of the liquid crystal pixel, which is more stable and reliable than the method to mix the different pixel colors by utilizing the characteristic of the visual retention and the visual inertia of the human eyes, and makes the picture quality displayed by the liquid crystal improved.

Embodiment 2 of the Extension Method for the Pixel Gray Scale

In the method of realizing gray scale extension by controlling the charging time of the pixel capacitance as shown in the above embodiment, for a constant-white liquid crystal display panel, the gray scale level becomes high as the gray scale voltage decreases, and the higher the gray scale level is, the brighter the colors can be displayed on the liquid crystal display panel; on the contrary, for a constant-black liquid crystal display panel, the gray scale level becomes high as the gray scale voltage decreases as well, and the higher the gray scale level is, the darker the colors can be displayed on the liquid crystal display panel. Regardless of the constant-white or constant-black liquid crystal display panel, the scheme of extension to the pixel gray scale in the embodiments of the present invention is applicable.

The secondary gray scale levels become high as the charging time of the gray scale voltage decreases when extending to the primary gray scale levels. As shown in FIGS. 3A-3F, in every primary gray scale level, the charging time of the gray scale voltage corresponding to the lowest gray scale level (GL(4*n*)) among the extended secondary gray scale levels is the original charging time; the charging time of the gray scale voltage corresponding to the highest gray scale level (GL(4*n*+3)) among the extended secondary gray scale levels is the shortest, but the gray scale voltage corresponding to the secondary gray scale level should be larger than that of the next primary gray scale level, namely, GL(*n*+1), in other words, larger than the gray scale voltage corresponding to the lowest gray scale level among the secondary gray scale levels extended from the next primary gray scale levels, so as to maintain the continuity of the gray scale levels.

As shown in FIGS. 2A-2E, the detailed controlling of the charging time of the gray scale voltage of the primary gray scale level is as follows: fixing the end timing of the charging time of the gray scale voltage of the primary gray scale level, forming different charging times of the extended secondary gray scale voltages by performing delay processing to the start timing of charging the gray scale voltage of the primary gray scale level.

Embodiment 1 of the Drive Method for Controlling the Pixel Charging Time

For the thin film transistor (referred to as TFT thereafter for short) liquid crystal display apparatus, the process of driving a pixel capacitance is that: a received data signal is converted and transmitted to the source driver, the data signal is digital/analog (referred to as D/A thereafter for short) converted into a gray scale voltage by the source driver, and output to the panel, then, pixels displayed on the liquid crystal panel are gated line by line by the source driver, and the gray scale voltages are output to pixel capacitances on the gated line of the liquid crystal panel, to perform display driving. However, due to the cost of the chip to be taken into consideration when deciding the number of the sampled bits in performing D/A conversion, the number of the gray scales that can be presented is limited, which results in the number of the colors that can be presented is very small.

Figure 4:
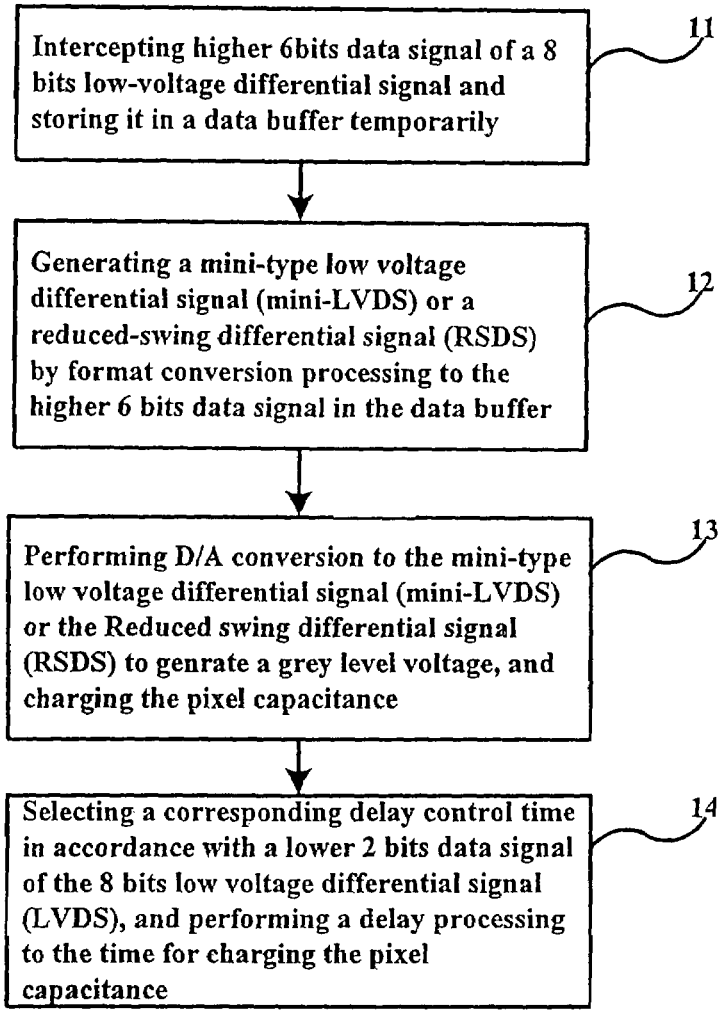
FIG. 4 is a flow chart of a drive method for controlling a pixel charging time of the present invention.

The drive method of controlling the pixel charging time used in the present embodiment makes improvement to the above drive process. The drive method used in the present embodiment can be generalized as shown in FIG. 4:

step 11, intercepting higher 6 bits data signal of a 8 bit low voltage differential signal and storing in a data buffer temporarily;

step 12, generating a mini-type low voltage differential signal or a low-amplitude differential signal by a format conversion processing to the higher 6 bits data signal in the data buffer;

step 13, performing D/A conversion to the mini-type low voltage differential signal or the low-amplitude differential signal to generate a gray scale voltage, and the gray scale voltage is performed A/D conversion by the source driver and output to the pixel capacitance to charge the pixel capacitance;

step 14, selecting a corresponding delay control time in accordance with a lower 2 bits data signal of the 8 bits low voltage differential signal, and performing a delay processing to the time for charging the pixel capacitance based on the delay control time.

As described in the above step 14, the corresponding delay control time is selected in accordance with the lower 2 bits data signal of the 8 bits low voltage differential signal, as shown in Table 1:

TABLE 1

| gray scale GL | lower 2 bits data signal | delay control time |
|---|---|---|
| 4N | 00 | 0 |
| 4N + 1 | 01 | t1 |
| 4N + 2 | 10 | t2 |
| 4N + 3 | 11 | t3 |

The lower 2 bits data signal can generate four different control channel address signals via conversion. In all the source channels of the respective lines on the liquid crystal panel, the displayed gray scales are 0, 4, 8 . . . , namely the multiple of 4. The control channel address signal of the pixel of GL(4N) is 00, the corresponding delay time is 0 when gating the channel, namely, there is no channel that performs controlling to the charging time of the corresponding gray scale voltage; the address of the channel in which the pixel of GL(4*n*+1) is located is 01, and the corresponding delay time is t1 when gating the channel; the address of the channel in which the pixel of GL(4N+2) is located is 10, and the corresponding delay time is t2 when gating the channel; the address of the channel in which the pixel of GL(4N+3) is located is 11, and the corresponding delay time is t3 when gating the channel.

As shown in FIGS. 3A-3F, the delay of the gray scale voltage output to the corresponding pixel capacitance of the liquid crystal panel can be controlled by the above control channel address signal, to adjust the charging time of the pixel capacitance, so that the same gray scale voltage (such as the voltage of GL0) corresponds to a plurality of charging times. Because of the difference of the charging time, the charging conditions of the pixel capacitances are different. The pixel capacitance with a long charging time is sufficiently charged, and its electrical field is more intensive (for example the charging time of the voltage of GL0 is not changed); the pixel capacitance with a short charging time is not sufficiently charged, and the electrical field is weaker (for example the charging time of the extended GL1, GL2 and GL3 are delayed by t1, t2 and t3 respectively). Thus, the same gray scale voltage can correspond to different electrical fields of the pixel capacitance. The liquid crystal molecules are deflected under the effect of the different electrical fields, and different gray scales can be generated to realize the extension to the gray scale (the single GL0 gray scale is extended into four gray scales of GL0, GL1, GL2 and GL3), thereby the number of gray scales that can be displayed on the liquid crystal panel is increased, and the quality of the display color is improved.

Embodiment 2 of the Drive Method for Controlling the Pixel Charging Time

The 8 bits low-voltage differential signal in step 11 of the above embodiment can be input via two branches. The number of the pixels that are displayed on each line of the liquid crystal panel is large, so inputting via two branches can ease the pressure of the data transfer, for example: where arranged in the pixel rows, all the 8 bits low-voltage differential signals corresponding to the (2n−1)th pixel can be transferred in one branch, and all the 8 bits low-voltage differential signals corresponding to the (2n)th pixel can be transferred in the other branch, wherein n is an positive integer, n=1, 2, 3 . . . . When two branches of data signals income, data is buffered; all the 8 bits data corresponding to the sub-pixels in one line of the liquid crystal display panel are mixed, arranged in line data to output, which can increase the data input efficiency and decrease the affect of the interference signal. In step 13, a shift process and a temporary storage are performed to the mini-type low voltage differential signals or the low-amplitude differential signals before the D/A conversion, so that the signals can be managed with high efficiency before conversion.

In addition, as shown in FIGS. 3A-3F, the extension from GL(n) to GL(4*n*) is a direct conversion without charging time control when controlling the charging of the pixel capacitance, however, GL(4*n*+1), GL(4*n*+2) and GL(4*n*+3) extended from GL(n) are subject to the charging time control. The rising edge of the gray scale voltage of GL(0) is before the gate open, and its charging process starts from the gate completely open. When the gate completely opens, all control channels with the control channel address signals being 0, namely, the source channels that does not subject to the charging time control are firstly selected, the pixel gray scale corresponding to the source channel is the extended GL(0). At this time, the electrical amount charged in the pixel in the channel is the gray scale voltage value as originally set; the pixel capacitance corresponding to the extended GL(1) corresponds to the control channel address signal 01, and the output of the gray scale voltage is increased by delay t1, causing its rising edge delayed than GL(0) by a period of time, which opens after the gate opens for t1 time, and the output circuit will gate the control channel defined as 01, namely, the charging time of the pixel capacitance of the pixel corresponding to GL(1) will be delayed by t1 time. Compared with GL(0), the charging time of GL(1) is shortened by t1, and its gray scale level is lower than that of GL(0). For the same reason, the capacitance charging time of the pixel corresponding to GL(2) will be further delayed, causing the control channel address signal 10 controlling the gray scale is gated after the gate opens for t2 (t2>t1) time. Compared with GL(1), the charging time of GL(2) is further shortened by (t2−t1) time. For the same reason, the capacitance charging time of the pixel corresponding to GL(3) is further delayed by t3(t3>t2).

It is to be noted that the GL(n+1) before extension, namely, the extended GL(4(n+1)) is the next primary gray scale level, and its gray scale voltage amplitude value B is lower than the gray scale voltage amplitude value A of GL(4*n*), but the charging times are the same. It should ensure that the charging amount of the extended GL(4*n*+3) should be more sufficient than that of GL(4(n+1)) when applying, so that the continuous transition of the gray scale is ensured.

Embodiment 1 of the Drive Apparatus for Controlling the Pixel Charging Time

Figure 5:
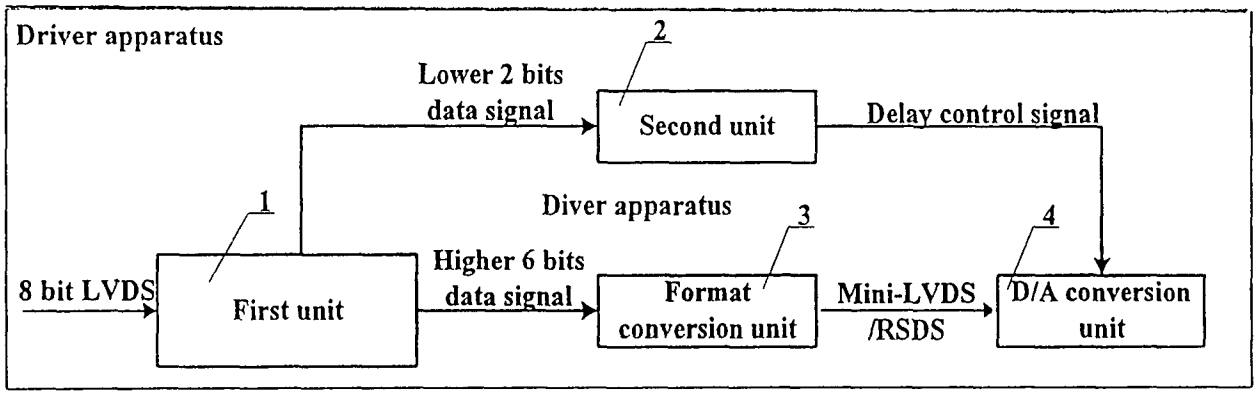
FIG. 5 is a schematic diagram of an embodiment 1 of the drive apparatus for controlling the pixel charging time of the present invention.

As shown in FIG. 5, the drive apparatus for controlling the pixel charging time comprises:

a first unit 1 for intercepting higher 6 bits data signal of a 8 bits low-voltage differential signal and outputting it to the format conversion unit 3; feeding lower 2 bits data signal of the 8 bits low-voltage differential signal into a second unit 2;

a format conversion unit 3 for generating a mini-type low voltage differential signal or a low-amplitude differential signal from the higher 6 bits data signal by format conversion processing;

a D/A conversion unit 4 for D/A converting the mini-type low voltage differential signal or the low-amplitude differential signal to generate a gray scale voltage which is output to a pixel capacitance to which charging is performed;

the second unit 2 is used for selecting a corresponding delay control time according to the lower 2 bits data signal of the 8 bits low-voltage differential signal, and a delay processing is performed to the charging time of the pixel capacitance according to the delay control time.

As shown in the above Table 1, firstly, a gate driver scans pixels on a liquid crystal panel line by line. When a certain line is gated, and after the mini-type low voltage differential signal or the low-amplitude differential signal received by the second unit 4 is converted into the gray scale voltage signal via the D/A conversion, the time of the gray scale voltage output to the pixel capacitance corresponding to the individual source channels of the line is controlled in accordance with the delay corresponding to the control channel address signal generated by the lower 2 bits data signals as shown in Table 1. Due to the delay, the voltages applied to the pixel capacitances are different; thereby the gray scale display thereon can be controlled to realize the purpose of pixel gray scale extension.

Embodiment 2 of the Drive Apparatus for Controlling the Pixel Charging Time

Figure 6:
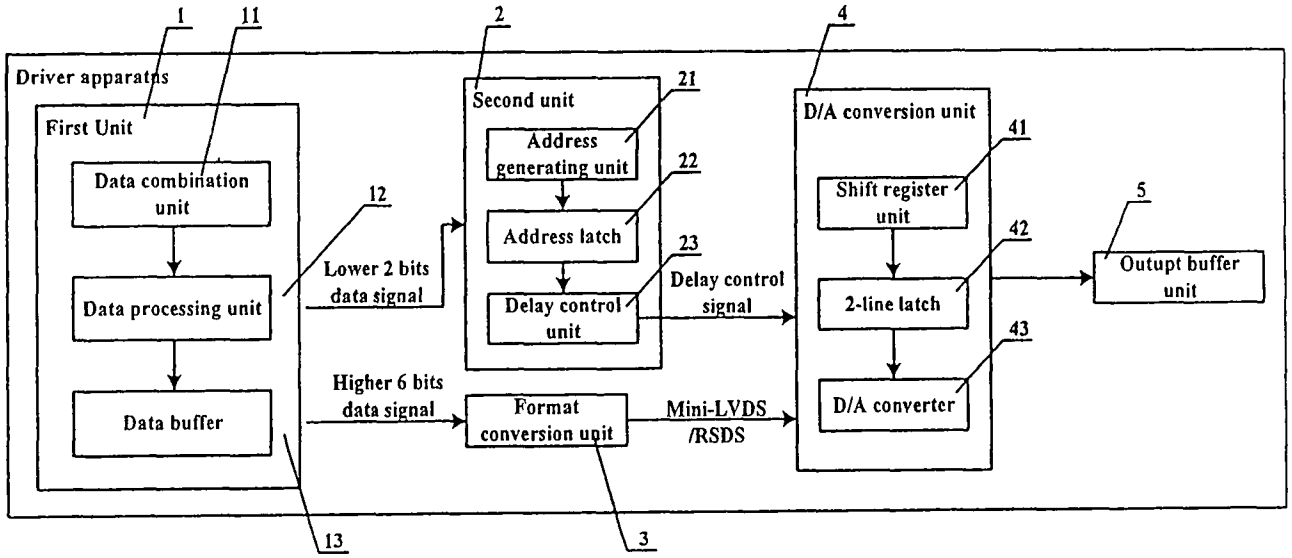
FIG. 6 is a schematic diagram of an embodiment 2 of the drive apparatus for controlling the pixel charging time of the present invention.

In the above embodiments, as shown in FIG. 6, the first unit 1 further comprises: a data combination unit 11 for data combing when the 8 bits low-voltage differential signal of the line are all input (because the liquid crystal pixels displayed on every line of the liquid crystal panel is large, the 8 bits low-voltage differential signal is generally input via two branches to decrease the data transfer frequency), and arranging data into lines then outputting; data processing unit 12 for performing data processing to the combined 8 bits low-voltage differential signal, intercepting the higher 6 bits data signal to feed to the data buffer 13 to buffer the data and wait for transmission; transmitting the buffered high 6 bits data signal to the format conversion unit 3, and the lower 2 bits data signal to the second unit 2.

As shown in FIG. 6, the second unit 2 further comprises: an address generating unit 21 for converting the lower 2 bits data signal of the 8 bits low-voltage differential signal into a control channel address signal; a address latch 22 for latching the control channel address signal; a delay control unit 23 for selecting a corresponding delay control time in accordance with the control channel address signal.

The D/A conversion unit 4 comprises in detail: a shift register unit 41 for performing shift storage processing to the input mini-type low voltage differential signal or the low-amplitude differential signal; a 2-line latch 42 for storing the 8 bits low-voltage differential data of the line being output and the 8 bits low-voltage differential data of the line that has not been outputted, in which the latch stores two lines of data to enable the data signal output in time and decrease the unnecessary waiting time; a D/A converter 43 for performing D/A conversion to the mini-type low voltage differential signal or the low-amplitude differential signal to generate the gray scale voltage, the gray scale voltage being output to the pixel capacitance and charging the pixel capacitance.

Finally, it should further comprise an output buffer unit 5 for managing the above output signal and outputting it at the proper time.

The liquid crystal apparatus of the present embodiments can further lower the interference of the noise and the other signals during the data transmission process, and further increase the picture quality of the liquid crystal display.

Finally, it should be appreciated that the above embodiments are merely to illustrate the technical solutions of the present invention, and are not of limitation. Although the present invention has been described in detail with reference to the embodiments described above, those of the ordinary skills in the art should understand that modifications can be made to the technical solutions set forth in the embodiments described above, or parts of the technical features therein can be replaced equivalently; and these modifications or replacements do not render the essence of the corresponding technical solutions departing from the spirit and range of the technical solutions of the various embodiments of the present invention.

What is claimed is:

1. A method of extending a pixel gray scale, comprising:

forming, by controlling an output time of a gray scale voltage of every primary gray scale level of a 6-bit data output from a source driver, a plurality of secondary gray scale levels with different charging times of pixel capacitances and the same gray scale voltage to realize an extension of the gray scale, so that 256 levels of gray scales are displayed with the 6-bit data output from a source driver, wherein the secondary gray scale level becomes higher as the charging time decreases, the gray scale voltage of every secondary gray scale level is the same as that of the corresponding primary gray scale, and the charging time is corresponding to the secondary gray scale level.

2. The method of extending a pixel gray scale of claim 1 wherein, in said every primary gray scale level, the charging time of the gray scale voltage corresponding to the lowest gray scale level among the plurality of different secondary gray scale levels is the charging time of the original primary gray scale level.

3. The method of extending a pixel gray scale of claim 2, wherein the control of the charging time of the gray scale voltage of the primary gray scale level is as follows: fixing a charging end timing of the gray scale voltage of the primary gray scale level; and forming different charging times of the plurality of secondary gray scale levels by delaying the charging start timing of the gray scale voltage of the primary gray scale level.

4. The method of extending a pixel gray scale of claim 1 wherein, in said primary gray scale level, the charging time of the gray scale voltage corresponding to the highest gray scale level among the plurality of different secondary gray scale levels is the shortest, and said gray scale voltage corresponding to the secondary gray scale level is larger than that of the next primary gray scale level.

5. The drive method of controlling a pixel charging time of claim 4 wherein, before D/A converting the mini-type low voltage differential signal or the low-amplitude differential signal, it further comprises: shift processing the mini-type low voltage differential signal or the low-amplitude differential signal, and storing it temporarily.

6. The method of extending a pixel gray scale claim 4, wherein the control of the charging time of the gray scale voltage of the primary gray scale level is as follows: fixing a charging end timing of the gray scale voltage of the primary gray scale level; and forming different charging times of the plurality of secondary gray scale levels by delaying the charging start timing of the gray scale voltage of the primary gray scale level.

7. The method of extending a pixel gray scale of claim 1, wherein the control of the charging time of the gray scale voltage of the primary gray scale level is as follows: fixing a charging end timing of the gray scale voltage of the primary gray scale level; and forming different charging times of the plurality of secondary gray scale levels by delaying the charging start timing of the gray scale voltage of the primary gray scale level.

8. A drive method of controlling a pixel charging time, comprising:

intercepting higher 6 bits data signal of a 8 bits low-voltage differential signal and storing it in a data buffer temporarily;

generating a mini-type low voltage differential signal or a low-amplitude differential signal by format conversion processing to the higher 6 bits data signal in the data buffer;

D/A converting the mini-type low voltage differential signal or the low-amplitude differential signal to generate a gray scale voltage, and said gray scale voltage being output to a pixel capacitance to charge said pixel capacitance; and selecting a corresponding delay control time in accordance with a lower 2 bits data signal of the 8 bits low-voltage differential signal, and performing a delay processing to the charging time of the pixel capacitance in accordance with the delay control time, wherein a plurality of secondary gray scale levels with different charging times of pixel capacitances and the same gray scale voltage are formed, by controlling an output time of the gray scale voltage of every primary gray scale level of a 6-bit data, to realize an extension of the gray scale, so that 256 levels of gray scales are displayed with the 6-bit data output from a source driver, and the secondary gray scale level becomes higher as the charging time decreases.

9. A drive apparatus for controlling pixel charging time, comprising:

a first unit for intercepting higher 6 bits data signal of a 8 bits low-voltage differential signal to output them to a format conversion unit, and to output a lower 2 bits data signal of the 8 bits low-voltage differential signal to a second unit;

the format conversion unit for generating a mini-type low voltage differential signal or a low-amplitude differential signal from the higher 6 bits data signal by format conversion processing;

a D/A conversion unit for performing D/A conversion to the mini-type low voltage differential signal or the low-amplitude differential signal to generate a gray scale voltage, and said gray scale voltage is output to a pixel capacitance to charge pixel capacitance; and the second unit for selecting a corresponding delay control time in accordance with the lower 2 bits data signal of the 8 bits low-voltage differential signal, and to perform a delay processing to the charging time of the pixel capacitance in accordance with the delay control time, wherein a plurality of secondary gray scale levels with different charging times of pixel capacitances and the same gray scale voltage are formed, by controlling an output time of the gray scale voltage of every primary gray scale level of a 6-bit data, to realize an extension of the gray scale, so that 256 levels of gray scales are displayed with the 6-bit data output from a source driver, and the secondary gray scale level becomes higher as the charging time decreases.

10. The drive apparatus for controlling the pixel charging time of claim 9 wherein said first unit comprises:

a data combination unit for performing data combination to the 8 bits low voltage differential signal in one line and to arrange the data in lines to output;

a data processing unit for performing data processing to every 8 bits low voltage differential signal after combination, and intercepting higher 6 bits data signal to feed into a data buffer and the lower 2 bits data signal to output to the second unit; and the data buffer for transmitting the buffered higher 6 bits data signal to the format conversion unit.

11. The drive apparatus for controlling the pixel charging time of claim 9 wherein said D/A conversion unit comprises:

a shift register unit for performing shift storage process to the input mini-type low voltage differential signal or the low-amplitude differential signal;

a 2-line latch for storing two lines of the 8 bits low voltage differential signals; and a D/A converter for performing D/A conversion to the mini-type low voltage differential signal or the low-amplitude differential signal.

12. The drive apparatus for controlling the pixel charging time of claim 9 wherein said second unit comprises:

an address generating unit for converting the lower 2 bits data signal of the 8 bits low-voltage differential signal into a control channel address signal;

an address latch for buffering the control channel address signal; and a delay control unit for selecting the corresponding delay control time in accordance with the control channel address signal.

* * * * *